US011725920B2

(12) United States Patent
Kruger et al.

(10) Patent No.: US 11,725,920 B2
(45) Date of Patent: Aug. 15, 2023

(54) DETONATOR SENSING ARRANGEMENT

(71) Applicant: DETNET SOUTH AFRICA (PTY) LTD, Johannesburg (ZA)

(72) Inventors: Michiel Jacobus Kruger, Johannesburg (ZA); Christopher Malcolm Birkin, Centurion (ZA); Richard Joseph Michna, Barkhamsted, CT (US); Daniel Auguste Maurissens, Orbe (CH); Andre Louis Koekemoer, Boksburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 142 days.

(21) Appl. No.: 17/422,622

(22) PCT Filed: Jan. 27, 2020

(86) PCT No.: PCT/ZA2020/050012
§ 371 (c)(1),
(2) Date: Jul. 13, 2021

(87) PCT Pub. No.: WO2020/160578
PCT Pub. Date: Aug. 6, 2020

(65) Prior Publication Data

US 2022/0090898 A1 Mar. 24, 2022

(30) Foreign Application Priority Data

Jan. 28, 2019 (ZA) ..... 2019/00561

(51) Int. Cl.
*F42D 1/04* (2006.01)
*F42D 1/05* (2006.01)

(52) U.S. Cl.
CPC ..... *F42D 1/043* (2013.01); *F42D 1/05* (2013.01)

(58) Field of Classification Search
CPC ... F42D 1/043; F42D 1/05; F42D 1/02; F42D 1/042; F42D 1/055; F42D 3/04; F42B 3/121; F42B 3/11; F42B 3/113; F42B 3/08; F42C 11/06; C06C 5/04; C06C 5/06
USPC ..... 102/206, 275.1–275.8, 215, 262, 217, 102/218, 201, 275.12; 361/248; 368/9
See application file for complete search history.

(56) References Cited

U.S. PATENT DOCUMENTS 5,423,263 A 6/1995 Rontey et al.
8,967,048 B2 3/2015 Harding et al.
(Continued)

FOREIGN PATENT DOCUMENTS

WO 2011044593 A1 4/2011
WO 2013131110 A1 9/2013

OTHER PUBLICATIONS

International Preliminary Report on Patentability for PCT/ZA2020/050012, international filing date of Jan. 27, 2020, date of completion Sep. 8, 2020, 20 pages.
(Continued)

*Primary Examiner* — Michael D David
(74) *Attorney, Agent, or Firm* — Cantor Colburn LLP

(57) ABSTRACT

A detonator which includes a housing which has a passage with an inlet and an outlet and which is of reducing cross sectional area from the inlet to the outlet and wherein the inlet is configured to be exposed to an end of a shock tube, and a fusible link is located at the outlet.

13 Claims, 2 Drawing Sheets

(56) References Cited

U.S. PATENT DOCUMENTS

| | | | | |
|---|---|---|---|---|
| 2012/0012019 | A1* | 1/2012 | Harding | F42D 1/05 368/9 |
| 2012/0111216 | A1* | 5/2012 | Koekemoer | F42C 15/184 102/201 |
| 2014/0261039 | A1* | 9/2014 | Koekemoer | F42D 1/055 102/201 |
| 2014/0311370 | A1* | 10/2014 | Koekemoer | F42C 11/001 102/217 |
| 2016/0313107 | A1* | 10/2016 | Birkin | F42D 1/055 |
| 2017/0322005 | A1* | 11/2017 | Labuschagne | F42D 1/05 |
| 2021/0404778 | A1* | 12/2021 | Michna | F42B 3/08 |
| 2022/0099416 | A1* | 3/2022 | Birkin | F42B 3/195 |

OTHER PUBLICATIONS

International Search Report for PCT/ZA2020/050012, international filing date of Jan. 27, 2020, date of mailing Apr. 28, 2020, 4 pages.
Written Opinion for PCT/ZA2020/050012, international filing date of Jan. 27, 2020, dated Apr. 28, 2020, 5 pages.

* cited by examiner

DETONATOR SENSING ARRANGEMENT

CROSS-REFERENCE TO RELATED APPLICATIONS

This application is a U.S. national stage application of International Application No. PCT/ZA2020/050012 entitled "DETONATOR SENSING ARRANGEMENT", which has an international filing date of 27 Jan. 2020, and which claims priority to South African Patent Application No. 2019/00561, filed 28 Jan. 2019.

BACKGROUND OF THE INVENTION

This invention relates to an electronic detonator which is used together with a shock tube. This type of detonator is described for example, in the specification of U.S. Pat. No. 8,967,048. U.S. Pat. No. 8,967,048 discloses a timing module capable of discriminating and verifying a shock tube event before triggering a timing delay. To this end, the timing module comprises a circuit board on which a discriminating arrangement is mounted. The discriminating arrangement includes sensors capable of detecting characteristics associated with shock tube even parameters. WO 2011/044593 discloses an electronic detonator capable of being initiated by a signal generated by a shock tube. The shock tube is coupled to a housing which contains a circuit, a battery and an ignition. Pressure from the shock tube causes a switch to be physically moved between an inoperative position where the circuit and the battery are not connected and an operative position where the battery is connected to the circuit, enabling the circuit to actuate the ignition.

In use a detonator of the aforementioned kind is connected to an end of a shock tube. Initiation of the shock tube results in the propagation of a shock tube event down a length of the shock tube. The shock tube event includes a pressurized wave front which contains plasma and is accompanied by a temperature increase and light emission.

To prevent a spurious initiation of the detonator extraneous factors must be eliminated. It is thus essential to detect characteristics which are uniquely associated with a shock tube event and to verify that these characteristics did, as a matter of fact, arise from a shock tube event.

The present invention relates to an arrangement which increases the likelihood that a shock tube event will be correctly detected and validated.

SUMMARY OF INVENTION

The invention provides an electronic detonator which includes an arrangement for sensing and validating the occurrence of a shock tube event, the arrangement including a support, a housing mounted to the support, a passage which extends through the housing, an inlet to the passage which is configured to be exposed to an end of a shock tube, an outlet from the passage, and at least one fusible link at the outlet, and wherein the inlet has a first cross-sectional area and the outlet has a second cross-sectional area and the first cross-sectional area is greater than the second cross-sectional area.

The passage between the inlet and the outlet may slope or taper smoothly i.e. reduce in cross-sectional dimension from the inlet to the outlet. This "funnel effect" helps to channel the wave front of a shock tube event smoothly towards the outlet, and concentrates or intensifies the wave front at the outlet which is where the fusible link is located.

A light sensor may be positioned downstream of the housing spaced from the outlet. The light sensor may be protected by means of a transparent cover produced for example by means of a moulding, or over-moulding, process of a suitable plastics material, or in any other way.

Structure may be included, downstream of the outlet, to reduce the likelihood that fragments of the fusible link which are ejected from the housing are returned towards the housing. This structure may include a plurality of formations adapted to intercept fragments reflected by a surface or surfaces at a location which is downstream of the outlet, towards the outlet.

The electronic detonator may include a processor or logic unit and a timer and the light sensor, fusible link and plasma sensor may be connected to provide input signals to the logic unit.

The fusible link may comprise a wire of an appropriate material and cross-section which is positioned so that the wire in a longitudinal direction is transverse to an axis of the passage in the housing. A conductive path through the fusible link is open-circuited with the fusible link breaks. This is detected by the processor or logic unit referred to. The link can be fragmented by the shock tube event but, preferably, by positioning the fusible link in the manner described, the fusible link is exposed to a maximum extent to the shock tube event and the link is then vaporised. This holds the benefit that fragments of the link are not generated. Such fragments could interfere with components or the working of the detonator and this possibility is practically eliminated if full vaporisation takes place.

The over-moulding of the light sensor, apart from providing protection for the light sensor, may be such that a sloping surface or surfaces are presented to the outlet. Consequently fragments of the fusible link which impact on the surfaces are less likely to be reflected by the surfaces back into the passage.

A plasma sensor may be located inside the housing.

BRIEF DESCRIPTION OF THE DRAWINGS

The invention is further described by way of example with reference to the accompanying drawings in which.

DESCRIPTION OF PREFERRED EMBODIMENT

Figure 1:
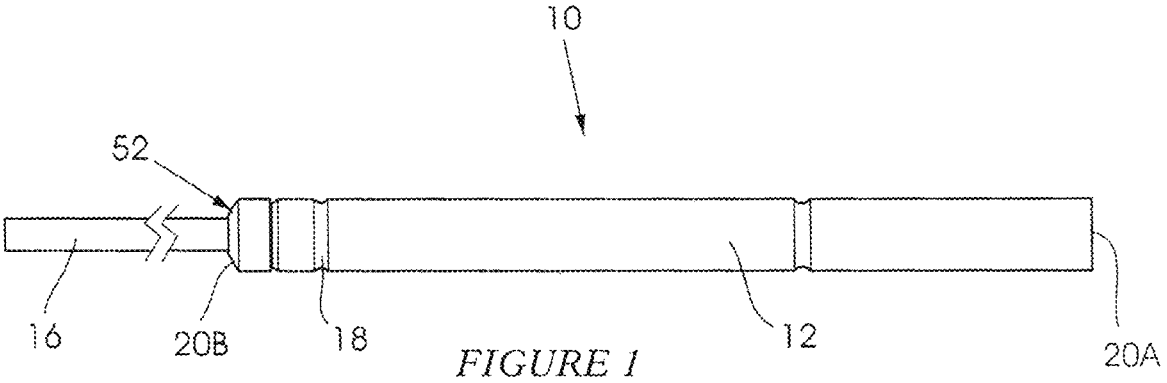
FIG. 1 illustrates a detonator according to the invention.

FIG. 1 of the accompanying drawings is a side view of a detonator 10 according to the invention. The detonator 10 includes a tube 12 which is made from any suitable material. The tube may be a non-metallic material e.g. a plastic or composite material or could comprise a thin wall metallic tube e.g. of copper. The tube 12 is connected to a shock tube 16 by means of crimp formations 8 on the tube 12.

Figure 2:
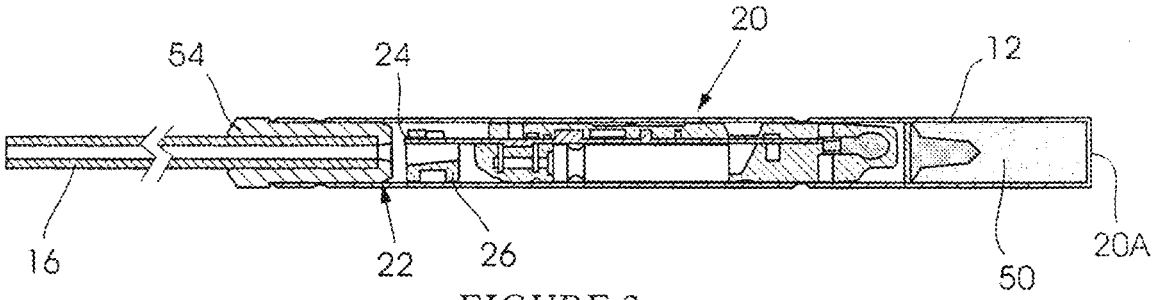
FIG. 2 is a side view in cross section of the detonator of FIG. 1.

Located inside the tube 12 is a detonator module 20—see FIG. 2. An end 22 of the shock tube 16 opposes an end surface 24 of a housing 26 inside the tube.

Figure 4:
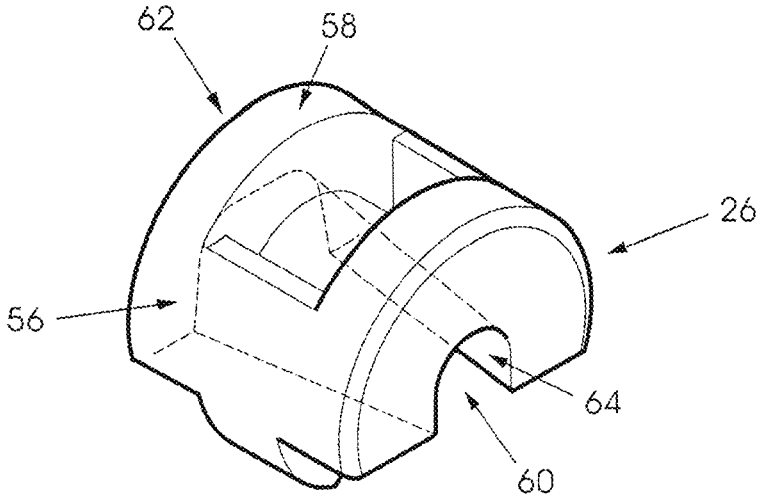
FIG. 4 shows in perspective, on an enlarged scale, a housing at one end of the detonator.
Figure 5:
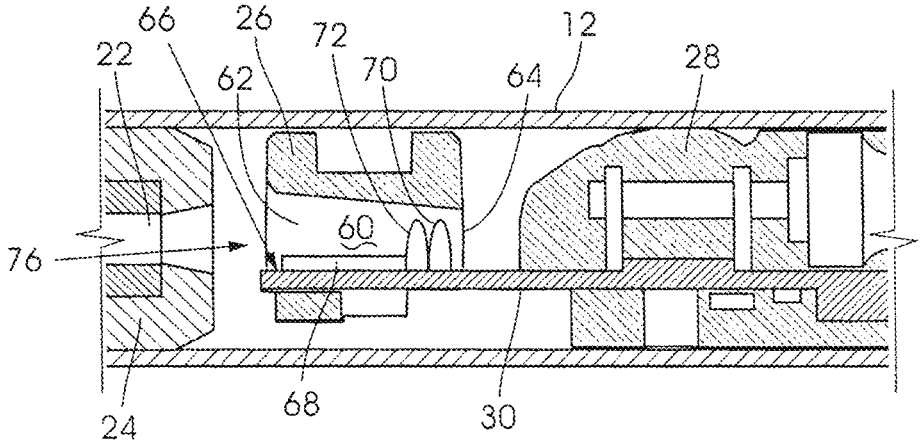
FIG. 5 is a side view in cross section of the housing of FIG. 4, and illustrates some adjacent components of the detonator.
Figure 6:
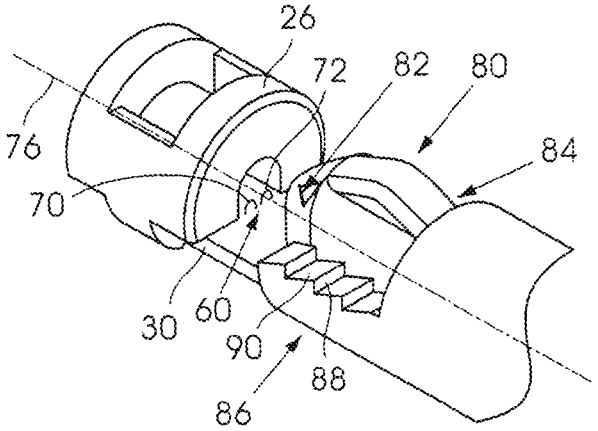
FIG. 6 is a perspective view of the arrangement shown in FIG. 5.

Referring in addition to FIGS. 4, 5 and 6, the module 20 includes a support in the form of a substrate 30, which typically comprises a printed circuit board and which provides support for the housing 26 and the remainder of the module 20.

Figure 3:
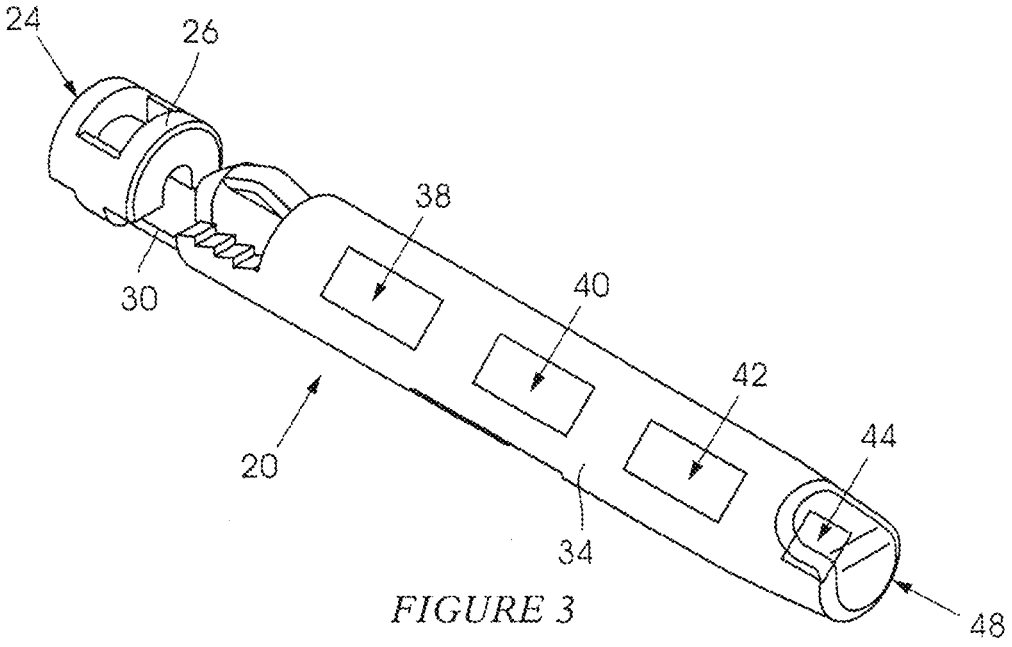
FIG. 3 is a perspective view of an electronic module included in the detonator.

The module 20 comprises an elongate shaped body 34 which is bonded to the substrate 30 which embodies a printed circuit board for the module. It is possible for the body 34 to be integrally formed or comprise a number of parts or components which are engaged e.g. clipped onto the substrate or otherwise fixed to the substrate. Mounted in the body 34 and connected to the printed circuit board are various components shown schematically in FIG. 3 which inter alia include a logic unit or processor 38, a timer 40, a battery 42 which acts as an energy source for the detonator module and a firing circuit 44 which, typically, is at an end 48 of the module which is remote from the housing 26. When the module 20 is engaged with the tube 12 the firing circuit 44 opposes a base charge 50, which is positioned inside the tube 12—see FIG. 2.

The body 34 is located inside the tube 20 which is closed at one end 20A. At an opposing end 20B the tube 20 has a mouth 52 which is configured to be engaged with the end 22 of the shock tube 34 by means of a shaped plug 54.

The housing 26 (FIGS. 4 and 5) includes a body 56 which is engaged with the substrate 30. The body 56 can be made from any suitable material and for example can be moulded from a plastics material. The body can be engaged with the substrate in any suitable way for example it can be clipped to the substrate or it can be directly moulded onto the substrate. It is also possible for the body to be engaged with a sliding action with the substrate or for the body to be glued to the substrate. The invention is not limited in this respect. The body 56 has a curved profile 58 which facilitates insertion of the housing into the tube 12. A passage 60 extends through the body 56 from an inlet 62 to an outlet 64. A portion of the substrate 30 forms a base 66 of the passage 60. The inlet 62 has a larger cross-sectional area than the outlet 64 and the passage 60 is tapered smoothly from the inlet 62 to the outlet 64 thereby decreasing in cross-sectional area.

A plasma sensor pad 68 is mounted to the base 66—see FIG. 5. One or multiple fusible links are fixed to circuit contact points on the substrate 30. In this example (which is non-limiting) two fusible links 70 and 72 respectively are fixed to circuit contact points on the substrate 30. Each link comprises a length of wire of a suitable composition and cross-section which extends in an arch form upwardly from the substrate. Each wire has a length which extends generally transverse to a longitudinal axis 76 of the passage. In this way a maximum surface area of each wire is positioned transverse to the longitudinal axis. Downstream of the outlet 64 and spaced therefrom is a structure 80 which is formed in any appropriate way. The structure 80 may be moulded together with the body 34 or it can be formed by means of an overmoulding or other process. The invention is not limited in this respect. The detonator includes an LED light sensor 82. The sensor may be embedded in the structure 80, which is of a light transmissive or transparent nature, so that the plastic material does not impede the detection by the sensor 82 of an incident light beam. The light sensor 82 can however be placed in any other convenient location. For example it could be embedded in the housing 26 or it could be placed on the substrate 30. Clearly the position of the light sensor must be such that its capability to detect an incident light beam is not adversely affected.

In the illustrated embodiment (FIG. 6) the light sensor 82 is flanked by saw tooth retention formations 84 and 86. In FIG. 6 only the formations 86 are shown. The formations 84, on an opposing side of the module 20, are similar to the formations 86. Each formation 84, 86 has a flat surface 88 which is transverse to the longitudinal axis 76 and a sloping surface 90 which is at an acute angle relative to the flat surface 88.

The manner in which the detonator functions is not described in detail herein for in general terms it operates in the manner described in the specification of the aforementioned U.S. Pat. No. 8,967,048. If the shock tube 16 is initiated then an ignition front is propagated along the length of the shock tube and reaches the shock tube end 22 which is directly exposed to the inlet 62 of the housing 26. Plasma generated by the shock tube event is detected by the plasma sensing pad 68 and a unique signal is sent by this sensor to the logic unit 42 in the module 20.

The pressure front which accompanies the shock tube event causes the fusible links 70 and 72 to be rendered non-conductive. As noted the links may break or they can be fragmented. Ideally the links should be vaporised so that link fragments are not formed. Each link functions as an electrical conductor and, when it is fused, its electrical status changes from conductive to open circuit and a responsive signal is generated. This signal is transmitted by a conductor in the printed circuit board carried by the substrate 30 to the logic unit 42 and is used for control and validation purposes. The light sensor 82 embedded in the plastic material 80, opposing the outlet 64, detects the light signal which is associated with the shock tube.

To avoid malfunctions, it is important to ensure that the fusible links 70 and 72 are disintegrated to a maximum extent by the shock tube event. To achieve this objective the passage 60, as noted, is tapered. This tapering helps to funnel the advancing wave front from the shock tube event and to concentrate or intensify the wave front at the outlet 64 which is where the fusible links 70 and 72 are positioned. The links, when they fuse, should ideally be totally vaporised. The links can be positioned directly in the outlet 64 or displaced from the outlet 64 to a slight degree into the passage 60. It is possible for the links to be displaced out of the passage by a small distance from the outlet.

If the shock tube 16 is initiated then an ignition front is propagated along the length of the shock tube and reaches the shock tube end 28 which directly opposes the housing 26. Plasma generated by the shock tube event is detected by the plasma sensor pad 68 and a unique signal is sent by the sensor to the logic unit 42 of the module 20.

Nonetheless the links can be fragmented (and not vaporised) and in that event, small pieces of hot metal are produced by the shock tube event. These fragments are ejected from the outlet 64 and propelled towards the plastics material 80. The material can reflect the impacting fragments and cause these fragments to return to the outlet 64. The fragments could, conceivably, impact on the plasma pad sensor. This is to be avoided.

As the outlet 64 is significantly smaller in cross-sectional area than any other part of the passage 60, the likelihood that fragments can move "backwardly" from the outlet and then fall onto the plasma sensor pad 68 is much reduced.

The plasma sensor pad 68 and the light sensor 82 are used to detect plasma and light respectively produced by a shock tube event. Preferably both characteristics must be detected to verify the existence of a genuine shock tube event. It is possible though to rely on one of these characteristics only but this should be in combination with the detection of the pressure wave by the fusible links.

In the illustrated embodiment in FIG. 6 the light sensor 82 is embedded in the transparent plastics material 80 which protects the light sensor. If, as indicated hereinbefore, the light sensor is at another position then, depending upon whether the sensor could be damaged by means of a shock tube event it is possible to protect the sensor in a similar way e.g. by using a protective light transmissive material. Fragments of the links 70, 72 which impact on the plastics material 80 do not therefore directly contact the light sensor 82 and this sensor can work unimpeded. The ability of the sensor to detect the light wave is however not adversely affected by the plastics material 80. Apart from protecting the light sensor against possible impact by fragments of the links 70 and 72 (due to the pressure wave of the shock tube event) the material 80 also protects the sensor against other possible adverse effects of the shock tube event such as the pressure wave, heat, plasma particles and so on.

Another factor is the provision of the saw tooth retention formations 84, 86 on opposed sides of the light sensor 82, which are designed to "trap" fragments which are produced when the links 70 and 72 are fused and which could then otherwise impact on and enter the body section. These fragments could be reflected through the outlet 64 and into the passage 66 and then fall onto the plasma sensor pad. The use of the retention structure means that a mechanism is provided which, at least to some extent, helps to prevent particles which are reflected towards the outlet from entering the outlet.

The saw tooth formations, apart from being designed to trap fragments which may be reflected back into the passage, present irregular surfaces to gasses escaping from the passage 66 and thereby create turbulence which tends to scatter particles emerging from the outlet. This turbulence reduces the possibility that the emerging particles could be reflected into the passage.

The plastics moulding 80 is also shaped so that to the extent possible under the circumstances, a surface which is at a right angle to the longitudinal axis 76 is avoided. Particles impacting on the surface of the plastics material are thus deflected or reflected to one side and are less likely to enter the passage.

The logic unit 38 is constructed to interpret each signal which reaches the logic unit from the plasma sensor pad 68, from the light sensor 82, and from the fusible links 20,22. These signals are subjected to a validation process to establish whether they arose from a genuine shock tube event or not. This is done in order to eliminate spurious signals which might be generated by an occurrence other than a shock tube event and which, if misinterpreted, could result in the detonator being fired inadvertently.

The invention claimed is:

1. An electronic detonator which includes an arrangement for sensing and validating the occurrence of a shock tube event, the arrangement including a support, a housing mounted to the support, a passage which extends through the housing and has a cross-sectional area dimension, an inlet to the passage which is configured to be exposed to a wave front produced at an end of a shock tube, an outlet from the passage, and at least one fusible link, at the outlet, which extends transversely to a longitudinal axis of the passage and wherein the passage between the inlet to the passage and the outlet from the passage is tapered to reduce the cross-sectional area dimension of the passage from the inlet to the outlet, so that the wave front from the shock tube event moving through the passage is concentrated at the outlet.

2. An electronic detonator according to claim 1 which includes a light sensor which is responsive to incident light produced by a shock tube event and which is positioned downstream of the inlet to the passage.

3. An electronic detonator according to claim 2 wherein the light sensor is downstream of the housing and is spaced from the outlet.

4. An electronic detonator according to claim 2 wherein the light sensor is located on the support.

5. An electronic detonator according to claim 2 wherein the light sensor is protected by means of a transparent cover.

6. An electronic detonator according to claim 1 which includes a structure downstream of the outlet, which structure includes a plurality of formations configured to intercept fragments of the at least one fusible link and to reflect fragments towards the outlet.

7. An electronic detonator according to claim 2 which includes a processor and a plasma sensor, and wherein the light sensor, the fusible link and the plasma sensor provide input signals to the processor.

8. An electronic detonator according to claim 5 wherein the transparent cover includes a surface which is configured to prevent fragments from the fusible link from entering the passage.

9. An electronic detonator according to claim 7 wherein the plasma sensor is located inside the passage.

10. An electronic detonator according to claim 1 which includes a tube and wherein said arrangement is in the form of a module located inside the tube.

11. An electronic detonator according to claim 10 wherein the sensing and validating arrangement includes a light sensor which is responsive to incident light produced by a shock tube event and the support includes a printed circuit board and wherein the detonator includes a processor, a timer, a battery and a firing circuit connected to the printed circuit board, and wherein the light sensor is positioned downstream of the inlet to the passage.

12. An electronic detonator according to claim 3 wherein the light sensor is protected by means of a transparent cover.

13. An electronic detonator according to claim 4 wherein the light sensor is protected by means of a transparent cover.

* * * * *